US009475620B2

(12) United States Patent
Wallis et al.

(10) Patent No.: US 9,475,620 B2
(45) Date of Patent: Oct. 25, 2016

(54) CLOSURE

(75) Inventors: Andrew John Wallis, Wantage (GB); Graham Martin Gossedge, Didcot (GB)

(73) Assignee: Crown Packaging Technology, Inc., Alsip, IL (US)

( * ) Notice: Subject to any disclaimer, the term of this patent is extended or adjusted under 35 U.S.C. 154(b) by 15 days.

(21) Appl. No.: 13/990,092

(22) PCT Filed: Nov. 8, 2011

(86) PCT No.: PCT/EP2011/069682

§ 371 (c)(1),
(2), (4) Date: May 29, 2013

(87) PCT Pub. No.: WO2012/072383

PCT Pub. Date: Jun. 7, 2012

(65) Prior Publication Data

US 2013/0248533 A1 Sep. 26, 2013

(30) Foreign Application Priority Data

Nov. 29, 2010 (EP) ..... 10192986

(51) Int. Cl.

| | |
|---|---|
| ***B65D 43/02*** | (2006.01) |
| ***B65D 17/50*** | (2006.01) |
| ***B65D 79/00*** | (2006.01) |

(52) U.S. Cl.

CPC ..... *B65D 43/0202* (2013.01); *B65D 17/502* (2013.01); *B65D 79/005* (2013.01); *B65D 2517/507* (2013.01); *B65D 2517/5013* (2013.01); *B65D 2517/5048* (2013.01); *B65D 2517/5054* (2013.01)

(58) Field of Classification Search

CPC ..... B65D 2543/0202; B65D 79/005; B65D 17/502; B65D 2517/5013; B65D 2517/507; B65D 2517/5048; B65D 2517/5054

USPC ..... 220/619, 359.1, 641, 610, 359.3, 269, 220/270, 265, 359.4, 359.2, 268, 359.5, 220/640, 612, 721, 203.09

See application file for complete search history.

(56) References Cited

U.S. PATENT DOCUMENTS

| | | | | | |
|---|---|---|---|---|---|
| 3,274,964 | A | * | 9/1966 | Griese, Jr. | 413/9 |
| 3,628,689 | A | * | 12/1971 | Rogers | 220/270 |
| 4,253,584 | A | * | 3/1981 | Bloeck et al. | 220/359.4 |
| 4,363,582 | A | * | 12/1982 | Bloeck et al. | 413/12 |
| 4,540,105 | A | * | 9/1985 | Wright | 220/359.2 |
| 4,544,080 | A | * | 10/1985 | Wright et al. | 220/359.2 |
| 4,557,398 | A | * | 12/1985 | Hambleton et al. | 220/270 |
| 4,637,543 | A | * | 1/1987 | Kucherer | 229/5.6 |
| 4,680,917 | A | * | 7/1987 | Hambleton et al. | 53/440 |
| 5,069,355 | A | * | 12/1991 | Matuszak | 220/270 |
| 5,156,329 | A | * | 10/1992 | Farrell | 229/125.35 |

(Continued)

FOREIGN PATENT DOCUMENTS

| | | |
|---|---|---|
| EP | 0683110 | 11/1995 |
| EP | 1777165 | 4/2007 |

(Continued)

*Primary Examiner* — James N Smalley
(74) *Attorney, Agent, or Firm* — Baker & Hostetler LLP

(57) ABSTRACT

This invention relates to an improved closure in the form of an annular component (2) closed by a peelable lidding material (9). More particularly, it relates to a closure which, in use on a container, is better able to respond differential pressure changes whilst also providing peelability.

22 Claims, 7 Drawing Sheets

(56) References Cited

U.S. PATENT DOCUMENTS

| | | | | |
|---|---|---|---|---|
| 5,178,293 | A * | 1/1993 | Suzuki et al. | 220/359.3 |
| 5,328,045 | A * | 7/1994 | Yoshida | 220/359.2 |
| 5,353,943 | A * | 10/1994 | Hayward | 220/276 |
| 5,395,005 | A * | 3/1995 | Yoshida | 220/359.2 |
| 5,725,120 | A * | 3/1998 | Ramsey et al. | 220/276 |
| 5,752,614 | A * | 5/1998 | Nelson et al. | 220/276 |
| 6,036,043 | A * | 3/2000 | Erfgen et al. | 220/270 |
| 6,220,471 | B1 * | 4/2001 | Lowry | 220/258.2 |
| 6,345,726 | B1 * | 2/2002 | Beeuwsaert | 220/359.3 |
| 6,601,727 | B2 * | 8/2003 | Sauer et al. | 220/359.2 |
| 7,055,713 | B2 * | 6/2006 | Rea et al. | 220/276 |
| 7,156,252 | B2 * | 1/2007 | Morin | 220/359.4 |
| 7,311,218 | B2 * | 12/2007 | Varadarajan | 220/257.1 |
| 8,287,220 | B2 * | 10/2012 | Oberholzer et al. | 413/62 |
| 8,413,834 | B2 * | 4/2013 | Oberholzer | 220/619 |
| 2004/0089664 | A1 * | 5/2004 | Rea et al. | 220/266 |
| 2005/0109784 | A1 * | 5/2005 | Varadarajan | 220/359.1 |
| 2005/0145630 | A1 * | 7/2005 | Williams et al. | 220/359.3 |
| 2005/0252918 | A1 * | 11/2005 | McKnight et al. | 220/359.3 |
| 2006/0151503 | A1 * | 7/2006 | Claydon | 220/359.1 |
| 2007/0272693 | A1 * | 11/2007 | Richards | 220/359.2 |
| 2008/0073365 | A1 * | 3/2008 | Jouillat et al. | 220/780 |
| 2008/0078766 | A1 * | 4/2008 | Oberholzer | 220/359.2 |
| 2008/0253863 | A1 * | 10/2008 | Heyn | 413/4 |
| 2009/0250464 | A1 * | 10/2009 | Jongsma et al. | 220/265 |
| 2010/0301045 | A1 * | 12/2010 | Docrot | 220/254.1 |
| 2012/0043329 | A1 * | 2/2012 | Zech et al. | 220/359.2 |

FOREIGN PATENT DOCUMENTS

| | | | | |
|---|---|---|---|---|
| EP | 2052984 | | 4/2009 | |
| EP | 2055641 | | 5/2009 | |
| EP | 2055641 | A1 * | 5/2009 | B65D 17/50 |
| WO | WO 2007/088212 | | 8/2007 | |

* cited by examiner

CLOSURE

CROSS-REFERENCE TO RELATED APPLICATIONS

This application is the National Stage of International Application No. PCT/EP2011/069682 filed Nov. 8, 2011, which claims the benefit of EP application number 10192986.7, filed Nov. 29, 2010, the disclosures of which are incorporated herein by reference in their entirety.

TECHNICAL FIELD

This invention relates to an improved closure for metal packaging in which a lid of peelable lidding material is sealed directly to a sealing panel of an annular component. The closure is particularly suitable for use on containers intended for packaging food products requiring sterilisation in a retort. In particular, the closure has the dual objectives of providing a strong seal able to sustain the pressure differentials applied to the lid as a result of the sterilisation process, whilst also being easily openable by a consumer.

BACKGROUND ART

In the field of metal packaging, closures are known having the general form of a metal annular ring component with a sealing panel to which is bonded a lid of peelable lidding material. Radially outwards of the sealing panel, the annular component extends first upwardly to define a chuck wall and then outwardly to define a seaming panel. The seaming panel enables the annular component to be seamed to the edge of a container body. Such closures are commonly used to close container bodies for food products requiring sterilisation in a retort. The sterilisation process subjects the container to high temperatures (typically up to around 130° C.) to ensure that the food within the container is stable for long-term storage and transport. The heating from the sterilisation process produces a consequent increase in pressure inside the container—a positive differential pressure. This positive differential pressure has to be sustained by the lidding material and its bond with the sealing panel of the annular component. The severity of the differential pressure "seen" by the bond is dependent upon whether a retort with balanced overpressure capability is used or not, because balanced overpressure helps to minimise the difference between the pressure inside the container to the pressure outside the container. For the avoidance of doubt, by "positive differential pressure" is meant where the pressure inside the container is greater than that outside the container, and by "negative differential pressure" is meant where the pressure inside the container is less than that outside the container.

EP 0683110 A (CARNAUDMETALBOX SA) 22 Nov. 1995 discloses a container having a closure with a sealing panel inclined relative to a horizontal plane. A lid of peelable lidding material is bonded to the sealing panel. The sealing panel inclination is fixed. When the container of EP0683110A is subjected to a positive differential pressure, the lid tends to dome outwardly. Having the sealing panel inclined at an angle consistent with the doming of the lid where the lid meets the radial inner edge of the sealing panel ensures that the bond between the lid and sealing panel is predominantly loaded in shear rather than in peel when subjected to the positive differential pressure. This therefore avoids the lid progressively peeling itself away from the sealing panel during sterilisation—a phenomenon known as "peelback". However, whilst having a fixed inclined sealing panel provides optimum performance during sterilisation, it does make the lid harder for a consumer to remove.

EP 2055641 A (IMPRESS METAL PACKAGING S.A.) 6 May 2009 discloses a closure in the form of a lid ring having radial outer and inner portions 2*a*, 2*b* (see FIG. 1 taken from EP2055641A). The radial inner portion 2*b* defines a sealing panel to which a foil lid 3 is bonded. The radial outer portion 2*a* has a wall that extends first upwardly from the junction with the sealing panel and then outwardly to define a seaming panel. A circumferential score line 30 is provided at the junction between the radial outer and inner portions 2*a*, 2*b* and, in effect, defines a "corner score". The junction between the radial outer and inner portions 2*a*, 2*b* defines a natural hinge, with the circumferential score line 30 improving the ability of the radial inner portion 2*b* to tilt about this hinge in response to differential pressures acting on the foil lid 3. The sealing panel inclination is intended to be able to adapt in response to changes in the differential pressure "seen" by the foil lid 3.

The present invention seeks to provide an alternative closure which provides improved performance to that disclosed in EP2055641A.

SUMMARY OF INVENTION

Accordingly, there is provided a closure for a container, the closure comprising a metal annular component, the annular component having a sealing panel adapted to support a lid of peelable lidding material bonded to the sealing panel to thereby define an annular bond region, the annular component terminating in an inner peripheral curl extending from the sealing panel to define an access opening for a container, the sealing panel being adjustably tiltable relative to a plane generally defined by the access opening under the action of a differential pressure acting over the area of the lid, characterised in that the sealing panel has radial inner and outer annular portions, the radial inner portion extending from the radial inside edge of the sealing panel for one quarter of the width of the sealing panel, and the radial outer portion extending for the remaining width of the sealing panel, the radial inner portion of the sealing panel configured with a circumferential hinge, the circumferential hinge provided as one or more annular thinned bands formed in the radial inner portion.

Note that for the purposes of determining the width of the sealing panel, the curl is excluded and not regarded as part of the sealing panel. The inner peripheral curl stiffens the annular component, which is beneficial in avoiding damage during transportation and handling.

By "thinned band" is meant that an annular region of the radial inner portion of the sealing panel is thinned relative to the surrounding material of the sealing panel.

By annular—as in "annular thinned band" (or "annular region")—is meant both:

- the case of where the band is continuous;
- and the case of where the band is discontinuous, i.e. made up of a number of discrete thinned band portions which collectively generally describe an annular profile.

Surprisingly, it was found that significant tilting of the sealing panel was possible when providing the circumferential hinge in the radial inner portion of the sealing panel, i.e. in close proximity to the curl. Most surprisingly, it was found that the inclination achieved by the invention for a given differential pressure could be greater than for the "corner score" of EP2055641A. In simple terms, the hinge of the invention is located close to the radial inside edge of the sealing panel, whereas the hinge provided by the "corner score" of EP2055641A is located at the radial outside edge of the sealing panel. Conventional thinking was that the stiffening effect provided by the annular "ring" construction of both the sealing panel and especially the inner peripheral curl would dictate that maximum tilting performance would be obtained by forming the hinge at the radial outer edge of the sealing panel (as in EP2055641A). Indeed, it was thought that providing the hinge close to the curl (as in the invention) would provide negligible additional tilting capability to the sealing panel—compared to an unscored closure—due to the stiffening provided by the inner peripheral curl. Finite element analyses disproved this conventional thinking and showed that the invention results in a surprising and counter-intuitive benefit relative to the known "corner score" of EP2055641A. The reason for the greater tilting performance when locating the hinge in close proximity to the inner peripheral curl (as in the invention) is thought to be that the annular thinned band defines a natural hinge in the sealing panel close to the curl, with the relatively rigid curl causing the sealing panel to bend about this hinge to alleviate the loads imposed by the differential pressure acting over the area of the lid. These analyses are discussed in the description of specific embodiments of the invention below.

The annular thinned band(s) may be formed by thinning of either or both of the upper and lower surfaces of the radial inner portion of the sealing panel. The thinning to provide such an "annular thinned band" may be provided in any numbers of ways and forms. Conveniently, the thinned band is formed as a score, by which is meant material is removed (typically by a cutting process) from the radial inner portion of the sealing panel to define an annular notch or groove, i.e. the "score". Alternatively, the thinned band may be defined as an annular depression; for example, a coining process (or similar process) may be used to stamp an annular depression (or coined region) in the radial inner portion of the sealing panel.

Although the closure may have one or more annular thinned band(s) formed on either or both of the upper and lower surfaces of the radial inner portion of the sealing panel, good tilting performance was able to be achieved with the sealing panel provided with only a single annular thinned band, the single band provided on the upper surface of the radial inner portion. Conveniently, it is preferred that the sealing panel is formed with one or more of the annular thinned band(s), these bands being confined to the upper surface of the radial inner portion of the sealing panel, with the lid bonded to the sealing panel so that the lid covers and the annular bond region extends either side of the thinned band(s). Confining the thinned band(s) to the upper surface of the radial inner portion provides the advantage of ensuring that any bare metal exposed by the process of forming the thinned band is covered and protected by the lid from environmental effects (such as corrosion). This is especially relevant when using a scoring process, which removes material from the sealing panel to expose bare metal. In contrast, the "corner score" of EP2055641A has a score radially outward of the bond between the lid and the lid ring, with bare metal exposed in forming the score on the lid ring remaining vulnerable to corrosion. Avoiding corrosion of the exposed score of EP2055641A would require a repair operation to seal the bare metal exposed by the score. The present invention avoids the need to perform such a repair operation due to the protection offered by the lid in covering and protecting the annular thinned band(s).

Preferably, the annular component is in the form of a metal ring distinct from and fastenable to the edge of a container body. For example, the metal ring may be provided with a seaming panel enabling the ring to be seamed to the edge of a container body. However, the annular component may also be integral to a container body.

The sealing panel is able to adjust in inclination in response to both positive differential pressure (resulting in the sealing panel tilting upwardly) and negative differential pressure (resulting in the sealing panel tilting downwardly).

Application of a positive differential pressure results in the material of the lid progressively doming outwardly and thereby inducing a load on the annular bond region sufficient to upwardly tilt the sealing panel. It was found that on removal of the positive differential pressure, the sealing panel returned to (or close to) its initial starting position (i.e. before application of the positive differential pressure). In this way, once the temperature and pressures resulting from a sterilisation process have subsided, the closure of the invention (as incorporated on a container) is able to be received by a consumer with a sealing panel inclination which assists ease of removal of the lid by the consumer. However, the upwards tilting of the sealing panel due to the positive differential pressure was found to induce plastic deformation in the annular component at the location about which the sealing panel tilted. The effect of this plastic deformation is that vacuum (or negative differential pressure) is required to return the sealing panel to its initial inclination. By way of example, analyses performed on a closure of 65 mm nominal diameter having a metal annular component made of CORUS Protact 0.13 mm gauge steel tinplate including a continuous annular score and first subjected to a positive differential pressure of 10 psi (0.69 bar), required a vacuum (or negative differential pressure) of around 5 psi (0.34 bar) to return the sealing panel to its initial inclination. The magnitude of the vacuum (or negative differential pressure) was dependent upon the location and presence of the score. For example, an identical closure (but without the annular score) subjected to the same positive differential pressure of 10 psi (0.69 bar) required a slightly higher vacuum (or negative differential pressure) of 7.3 psi (0.50 bar) to return the sealing panel to its initial inclination.

As indicated in the specific description of the invention below, finite element analyses have been performed using steel tinplate and aluminum for the metal of the annular component. In particular, the following commercially available materials have been analysed for the purposes of proving the invention:

CORUS Protact 0.13 mm gauge steel tinplate
CORUS Protact 0.19 mm gauge steel tinplate
Rasselstein HF3 0.13 mm gauge steel tinplate
0.13 mm gauge aluminium The lid is preferably formed using aluminium as a gas-tight barrier layer.

However, the invention is not limited to particular metals for the lid or the annular component.

The metal of the annular component (and more particularly the sealing panel) is preferably coated with one or more polymer coatings to prevent chemical interactions (e.g. corrosion) occurring between the metal and external environment. Preferably, coatings are chosen which enable formation of a peelable heat sealable bond with the lid. Examples of suitable polymer coatings include epoxy-based lacquers and polypropylene-based lacquers.

Similarly, the surface of the lid which opposes the sealing panel of the annular component is preferably covered coated with one or more polymer coatings. As for the annular component, it is preferred that coating materials are chosen which enable formation of a peelable heat sealable bond with the annular component. Use of lacquer systems containing polypropylene have been found particularly suitable for enabling formation of a heat seal bond with the sealing panel of the annular component. Although the use of coatings on the lid and annular component which include polypropylene is preferred, a stronger bond is able to be achieved using PET coatings. The use of PET in coatings on the corresponding surfaces of either or both of the lid and the sealing panel to establish the annular bond region enables the closure to sustain a higher positive differential pressure without the lid suffering from peelback.

Note: For this FIG. 1, the feature numbering corresponds to that from EP2055641A. The figures listed below which illustrate the invention have their own feature numbering.

Figure 2:
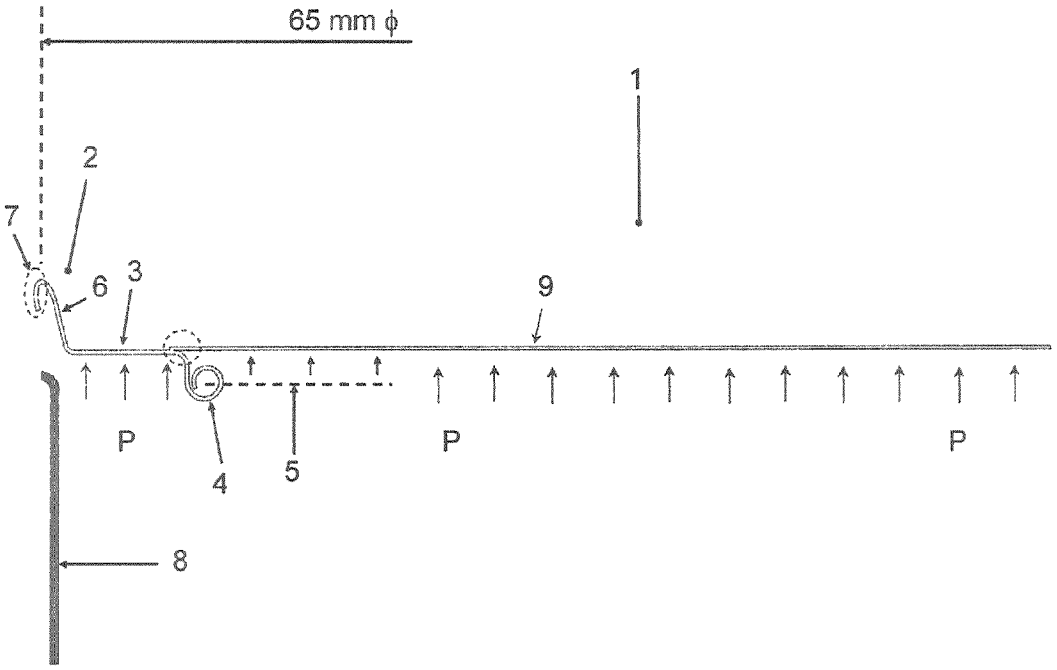

An embodiment of the invention is described below with reference to the following drawings:

FIG. 2 shows how the tilting capability of the sealing panel of various closures was modelled using finite element analysis.

Figure 3:
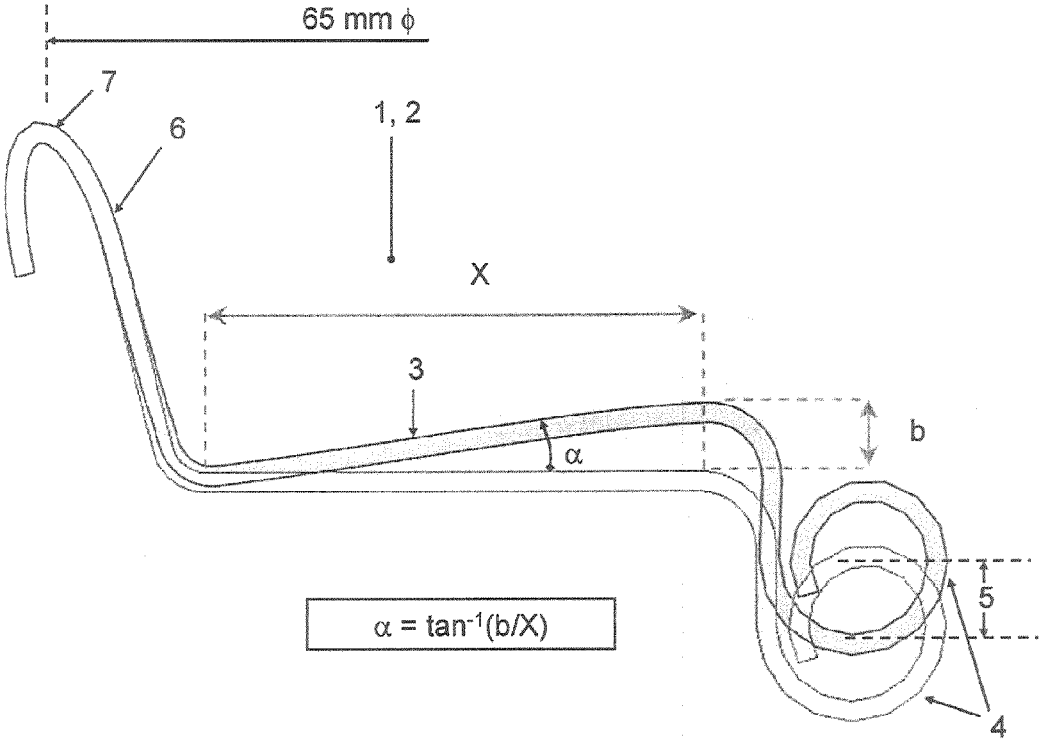

FIG. 3 shows how the angular deflection or tilt response of the sealing panel was measured.

Figure 4:
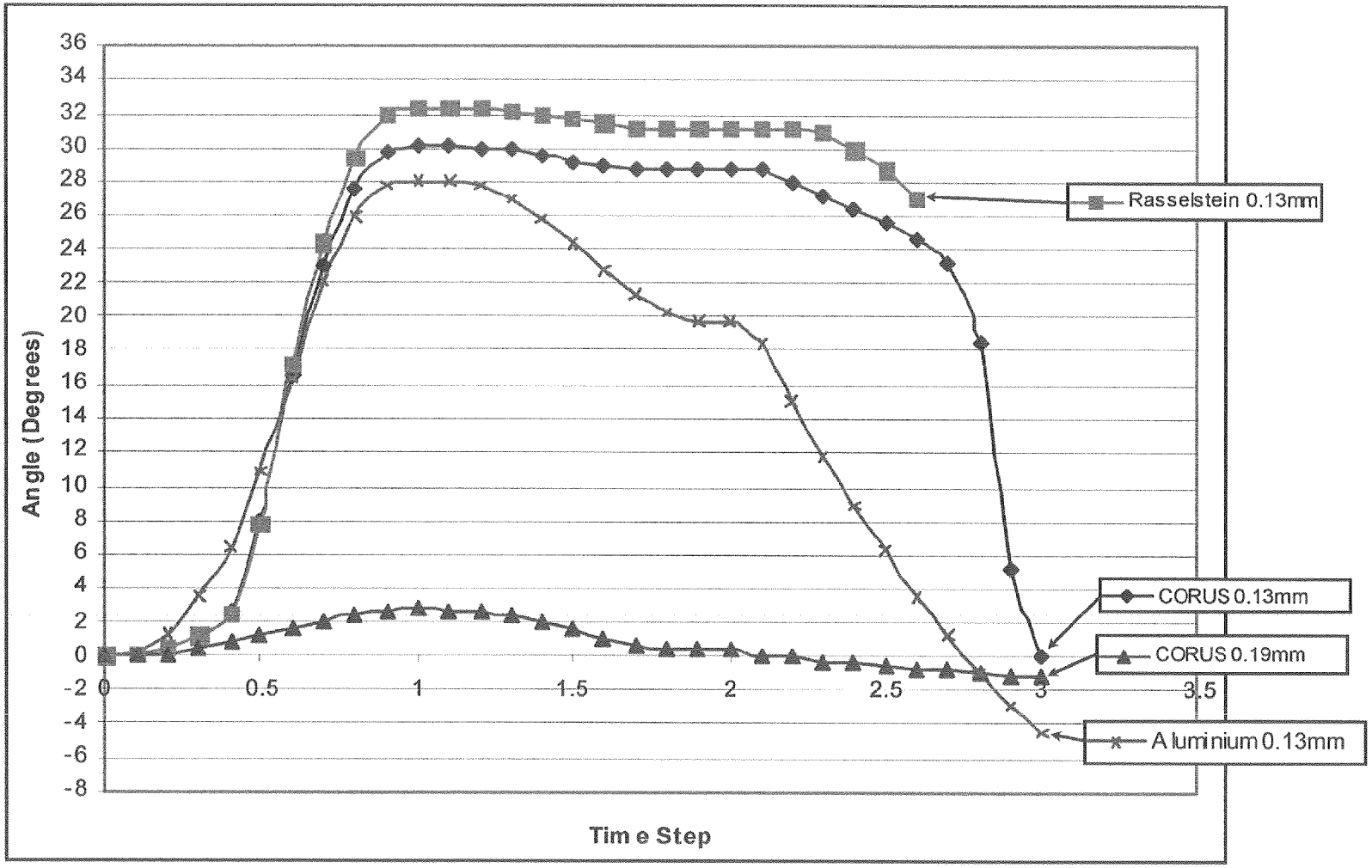

FIG. 4 shows the angular deflection or tilt response of the sealing panel of a known (unscored) closure for four different metals.

Figure 5:
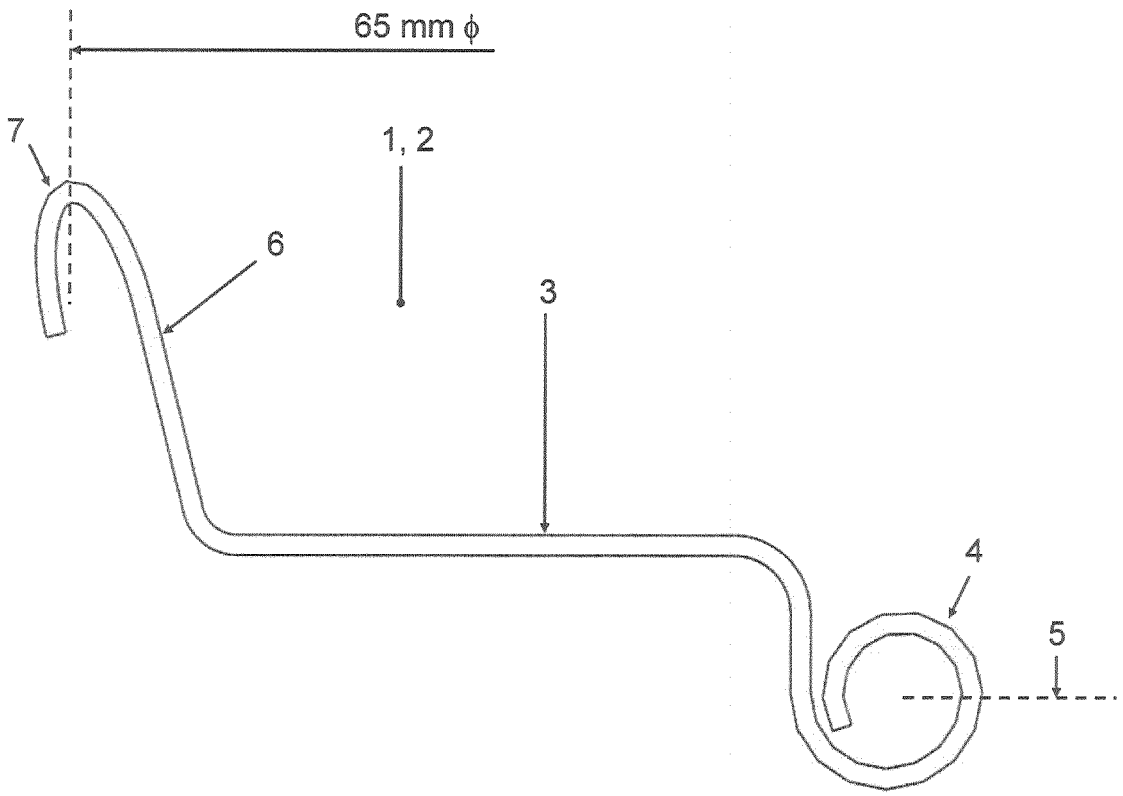
FIGURE 5 (Prior Art)

FIG. 5 shows a known (unscored) closure of the background art (but without the lidding material attached).

Figure 6:
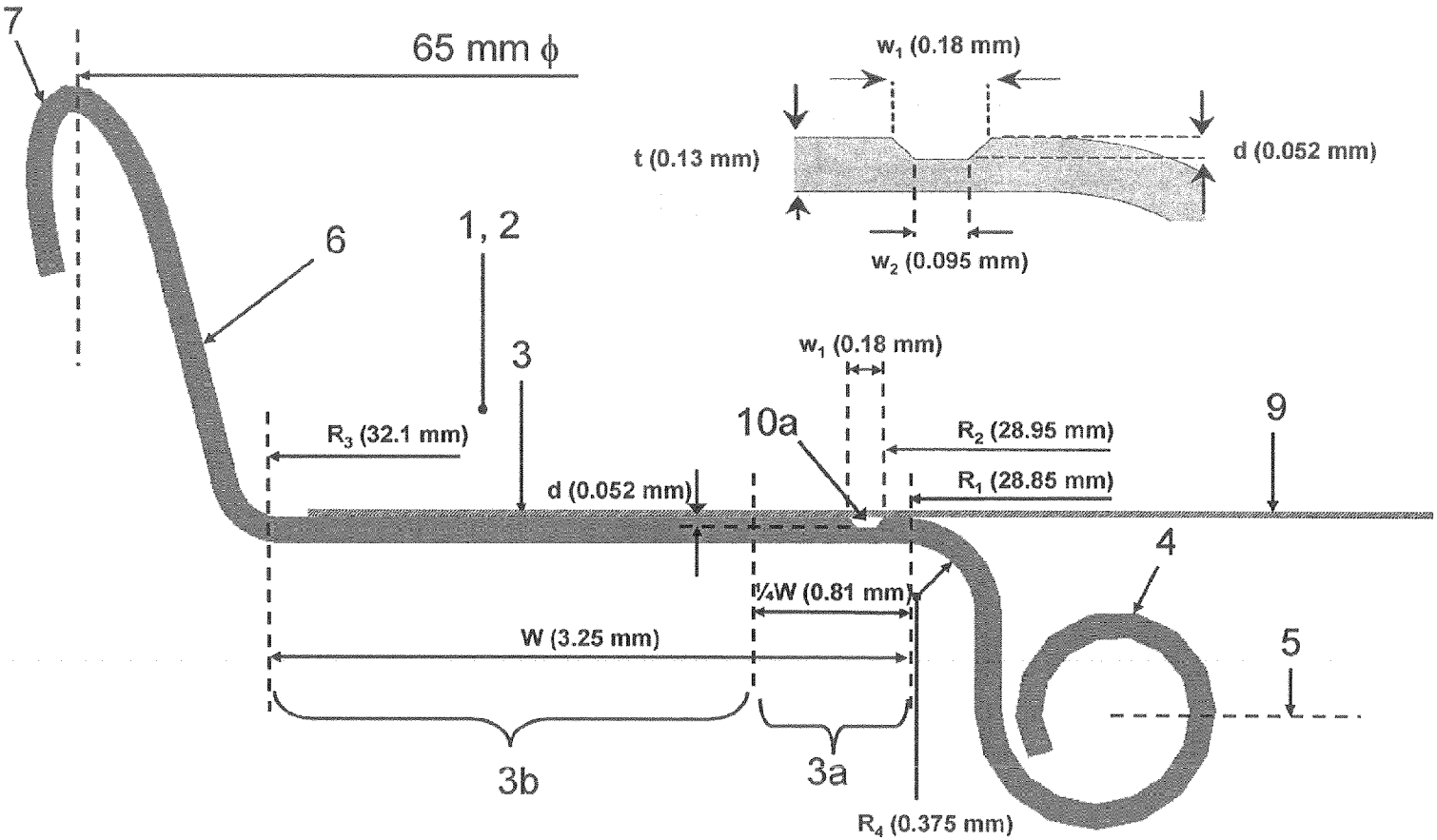

FIG. 6 shows a scored closure according to the invention (but with the lidding material attached).

Figure 7:
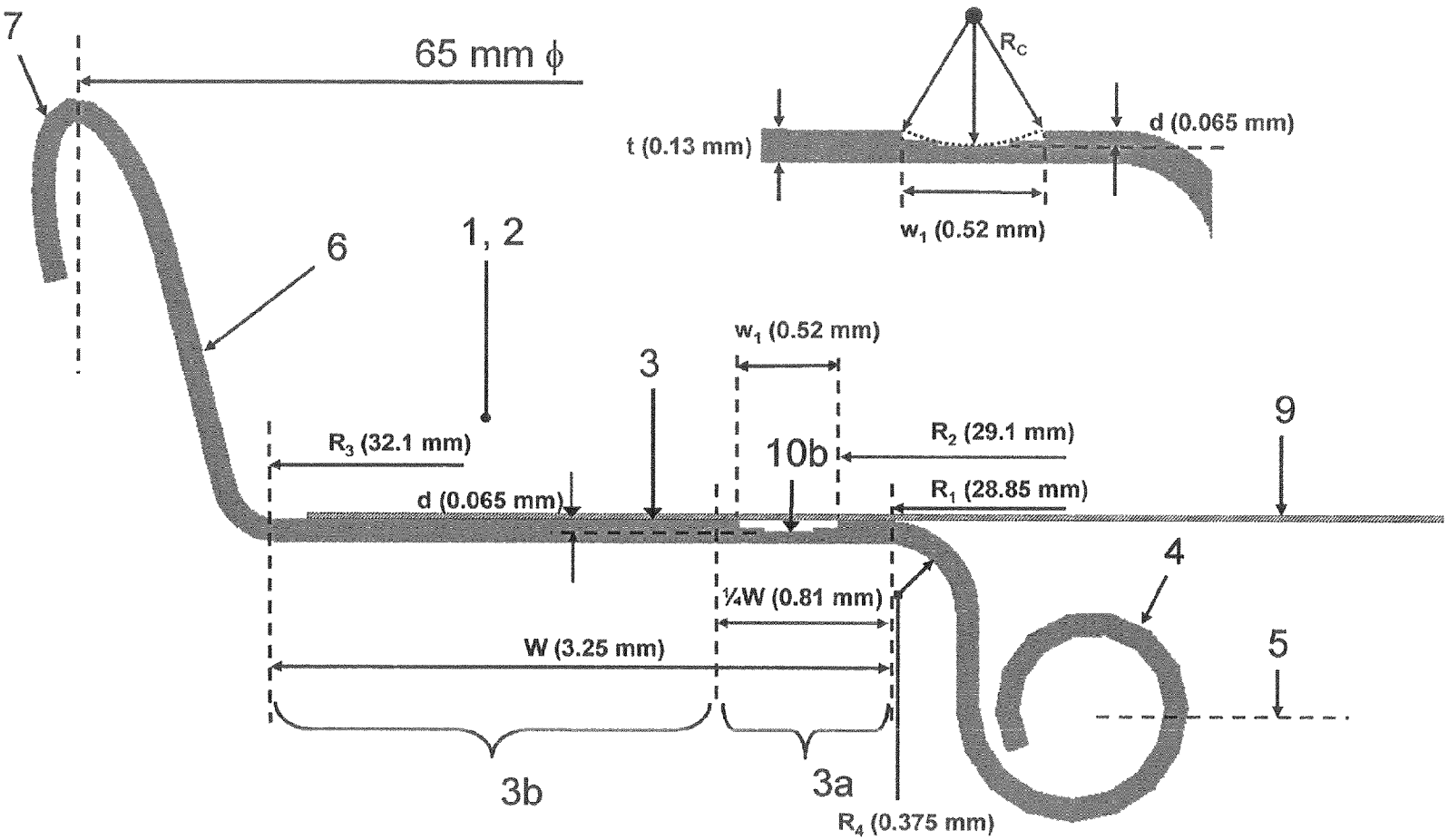

FIG. 7 shows a coined closure according to the invention (but with the lidding material attached).

Figure 8:
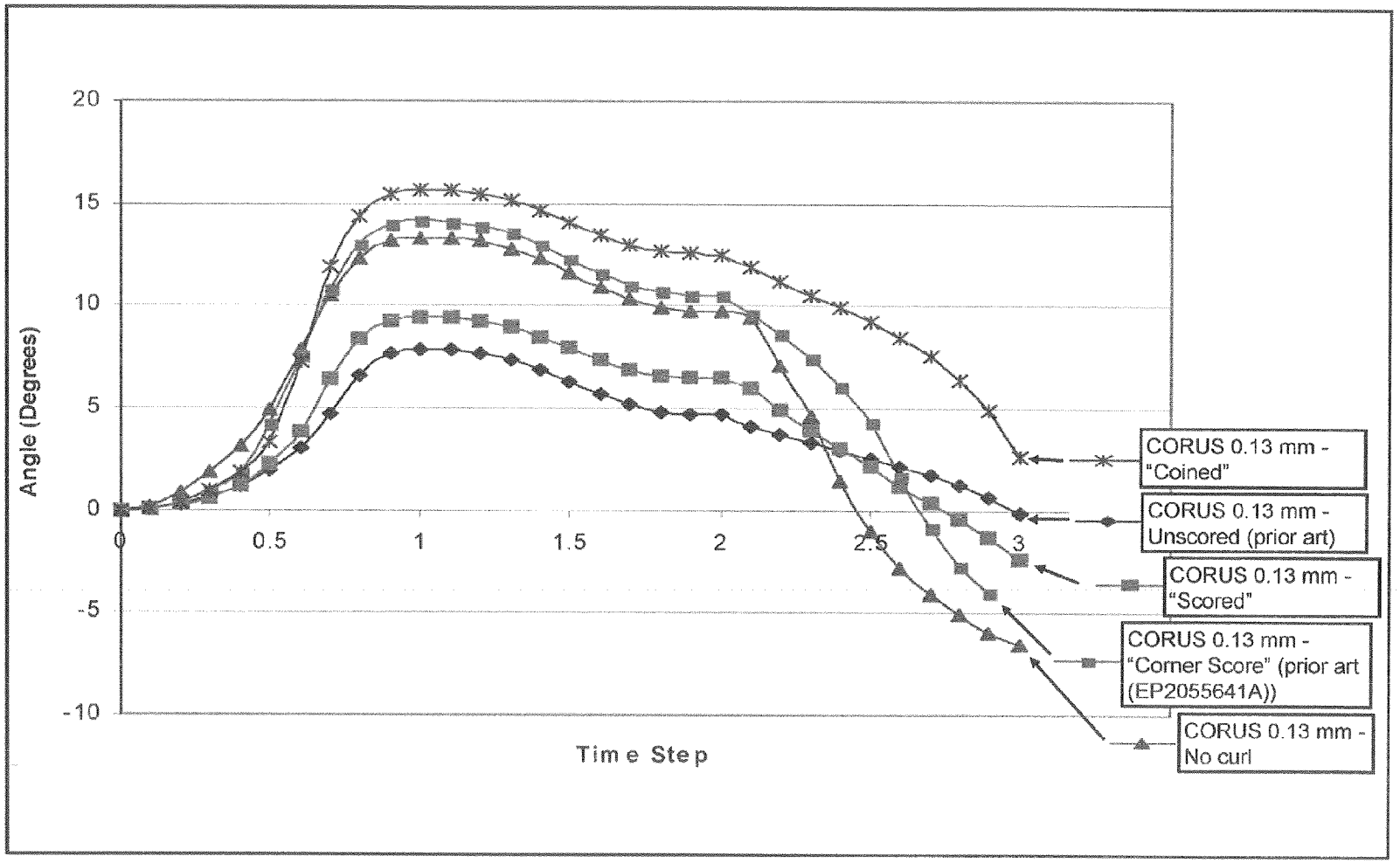

FIG. 8 shows the tilt response of the sealing panel of four different closures corresponding to those shown in FIGS. 1, 5, 6 & 7.

DESCRIPTION OF EMBODIMENTS

Finite element analyses and practical tests were performed on different closures of the background art and the invention to demonstrate the effect of the location of an annular score or coined region on tilting performance when subject to differential pressures. The closures as modelled and tested had a nominal diameter ϕ of 65 mm. FIG. 2 illustrates how the performance of closures of the invention (and the background art) was modelled using finite element analysis. FIG. 2 shows a closure 1 in the form of a metal annular ring 2. The annular ring 2 is provided with a sealing panel 3. An inner peripheral curl 4 joins and extends radially inwards from the sealing panel 3. The curl 4 defines an access opening through which product may be dispensed when used on a container body. The horizontal plane generally defined by the access opening is indicated by 5. A chuck wall 6 extends first upwardly from the radial outer periphery of the sealing panel 3 and then outwardly to define a seaming panel 7. The seaming panel 7 enables the annular ring 2 to be fastened to the outwardly flared edge of a container body 8 by a conventional seaming process. An aluminium foil lid 9 is circumferentially bonded to the sealing panel 3. For the cases modelled using finite element analysis, the sealing panel 3 is initially non-inclined (i.e. it extends generally parallel to the horizontal plane 5). However, in alternative embodiments, the sealing panel 3 may be inclined initially. The finite element analyses modelled the progressive gradual application and removal of pressure P to the underside of the lid 8 (see FIG. 2). This application of pressure P simulated the positive differential pressure applied to the lid 9 during sterilisation in a retort for a container incorporating the closure 1. In a second step, the finite element analyses then modelled the application of a vacuum (negative differential pressure) to determine the pressure required to return the sealing panel 3 to its initial non-inclined state.

FIG. 3 shows how the tilt response or angular deflection α of the sealing panel 3 relative to the horizontal plane generally defined by the closure 1 was measured. This figure shows both the i) initial undeflected profile of the sealing panel 3 and ii) the deflected profile of the sealing panel 3 under the action of the positive differential pressure P.

FIG. 4 is a graph of the tilt response or angular deflection of the sealing panel 3 in response to the progressive gradual application and removal of pressure P having a peak value of 20 psi (1.38 bar) for the known (unscored) closure configuration 1 shown in FIG. 5. The annular ring 2 of the closure 1 of FIG. 5 was analysed for four different materials and gauges:

CORUS Protact 0.13 mm gauge steel tinplate
CORUS Protact 0.19 mm gauge steel tinplate
Rasselstein HF3 0.13 mm gauge steel tinplate
0.13 mm gauge aluminium The graph shows the influence of material type and gauge on the tilting behaviour of the sealing panel 3 under the action of pressure P applied to the lid.

Figure 1:
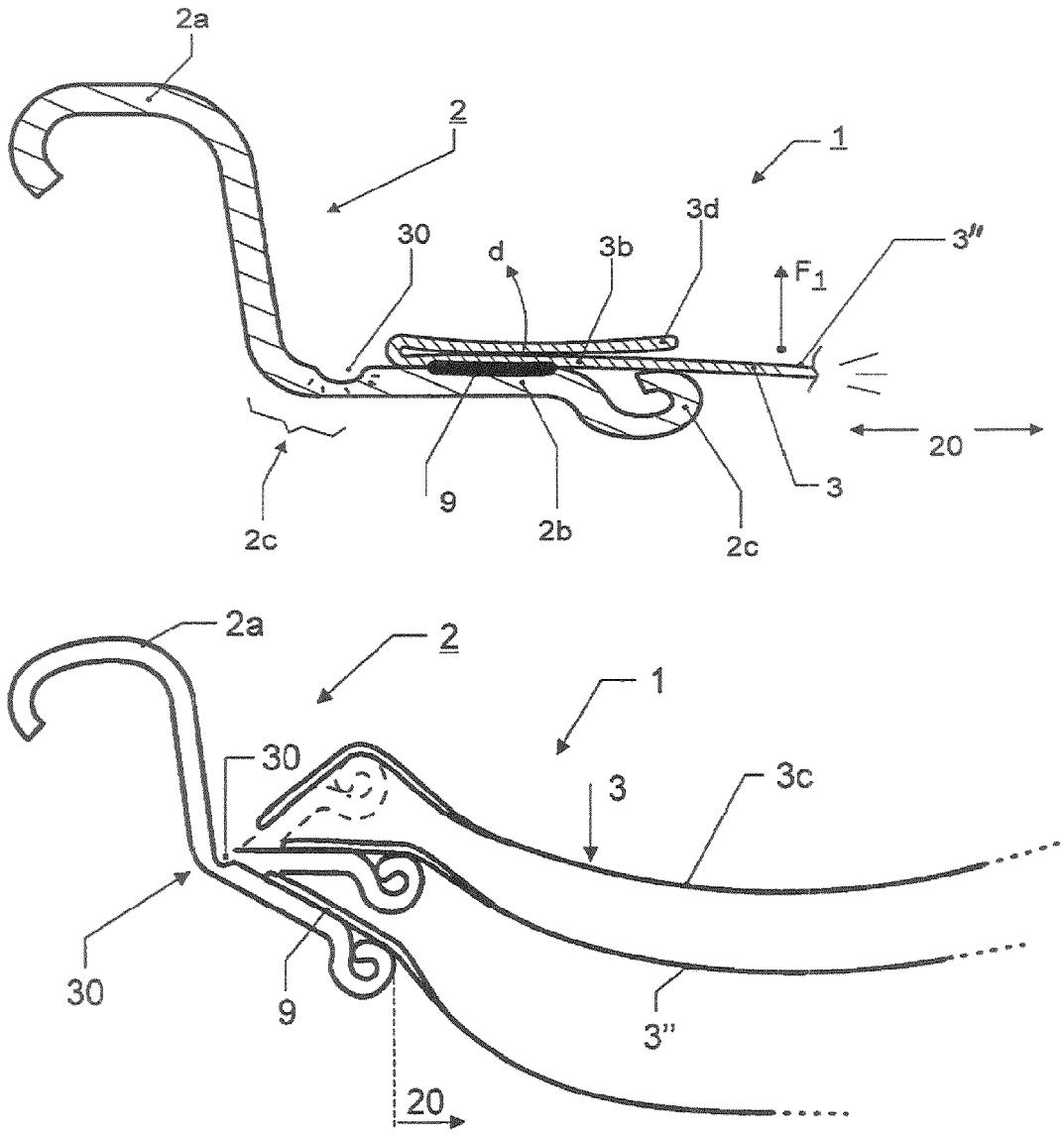
FIGURE 1 (PRIOR ART)
FIG. 1 shows a known closure having a "corner score" as disclosed in EP2055641A.

Separate analyses were then performed based upon using the CORUS Protact 0.13 mm gauge steel tinplate material for the annular ring 2, but comparing different closure configurations. Analyses were performed to determine the tilt response or angular deflection of the sealing panel 3 in response to the progressive gradual application and removal of pressure P having a peak value of 10 psi (0.69 bar) for the following closure configurations:

Prior Art:
- Unscored closure of FIG. 5 (prior art)
- Closure having a "corner score" as per EP2055641A (prior art) (see FIG. 1)

Invention:
- Scored closure having a single annular thinned band in the form of a continuous score 10*a* provided on the upper surface of the sealing panel 3 (referred to as "Scored")—as indicated in FIG. 6. The score 10*a* is located on the radial inner portion 3*a* of the sealing panel 3, the radial inner portion 3*a* extending from the radial inside edge of the sealing panel for one quarter (¼) of the width W of the sealing panel. The remaining width of the sealing panel 3 is referred to as the radial outer portion 3*b*. The radial inside and outside edges for the sealing panel 3 are marked up as $R_1$ and $R_3$ respectively on FIG. 6. The radial inside edge of the score 10*a* where it meets the upper surface of the sealing panel 3 (i.e. the "top" of the score) is marked up as $R_2$. The width of the "top" and "bottom" of the score 10*a* is marked up as $w_1$ and $w_2$ respectively. For the score 10*a* shown in FIG. 6, the width $w_1$ of the top of the score extends for some 5.5% of the width W of the sealing panel 3. As also shown in FIG. 6, the score 10*a* extends to a uniform depth d of 40% of the thickness t of the sealing panel 3.
- Coined closure having a single annular thinned band in the form of a continuous coined region 10*b* (referred to "Coined")—as indicated in FIG. 7. In common with the score 10*a* of FIG. 6, the coined region 10*b* is located in the radial inner portion 3*a* of the sealing panel 3. As for FIG. 6, the radial inside and outside edges for the sealing panel 3 are marked up as $R_1$ and $R_3$ respectively on FIG. 7. The radial inside edge of the top of the coined region 10*b* where it meets the upper surface of the sealing panel 3 (i.e. the "top" of the coined region) is marked up as $R_2$. The width of the "top" of the coined region 10*b* is marked up as $w_1$. As also shown in FIG. 7, the coined region 10*b* extends to a uniform depth d of 50% of the thickness t of the sealing panel 3. For the coined region 10*b* shown in FIG. 7, the top of the coined region extends for some 16% of the width W of the sealing panel 3. As also shown in FIG. 7, the coined region 10*b* that results from the coining process produces a curved convex depression in the sealing panel 3 approximating to an arc of radius $R_c$.

FIG. 8 is a graph of the tilt response or angular deflection of the sealing panel 3 in response to the progressive gradual application and removal of pressure P having a peak value of 10 psi (0.69 bar) for all four closure configurations referred to above. It can clearly be seen that the "Coined" invention embodiment of FIG. 7 surprisingly provides an increased peak angular deflection (15.6°) of the sealing panel relative to the "Corner Score" closure (14°) disclosed in EP2055641A. Further, even the embodiment of FIG. 6 achieves a peak deflection response of 8°, despite its score 10*a* being shallower in depth and narrower in width than the coined region 10*b* of the embodiment of FIG. 7.

Both FIGS. 6 and 7 clearly show the lid 3 covering the score 10*a* and coined region 10*b* and thereby protecting any bare metal exposed by the process of forming the score/coin from the effects of corrosion. This is in contrast to the "corner score" of EP2055641A in which any bare metal exposed in forming the score would remain exposed and vulnerable to the effects of corrosion.

The practical tests differed from the finite element analyses in that the corresponding surfaces of the lid 9 and sealing panel 3 each included coatings of heat sealable material, with coatings containing polypropylene. However, these coatings offer negligible structural rigidity to the lid 9 and therefore the finite element analysis studies modelled the lid as being made wholly of aluminium.

The invention claimed is:

1. A closure for a container, the closure comprising:

a metal annular component, the annular component having a sealing panel adapted to support a lid of peelable lidding material bonded to the sealing panel to thereby define an annular bond region, the annular component terminating in an inner peripheral curl extending from the sealing panel to define an access opening for the container, the sealing panel being adjustably tiltable relative to a plane generally defined by the access opening under action of a differential pressure acting on an area of the lid, characterised in that the sealing panel has radial inner and outer annular portions, the radial inner portion extending from the radial inside edge of the sealing panel for one quarter of a radial width of the sealing panel, and the radial outer portion extending for a remaining radial width of the sealing panel, the radial inner portion of the sealing panel having a circumferential hinge, the circumferential hinge defined by one or more annular bands, the one or more annular bands being thinned relative to surrounding material of the sealing panel.

2. A closure as claimed in claim 1, wherein:

i. in the case of a single annular band, the single band is discontinuous; or ii. in the case of two or more annular bands, at least one of the bands is discontinuous.

3. A closure as claimed in claim 1, wherein the sealing panel is provided with only a single annular band, the single band provided on an upper surface of the radial inner portion.

4. A closure as claimed in claim 1, wherein the one or more of the annular band(s) are disposed on an upper surface of the radial inner portion of the sealing panel, with the lid bonded to the sealing panel so that the lid covers and the annular bond region and extends either side of the band(s).

5. A closure as claimed in claim 1, wherein the one or more annular band(s) is provided by one or more annular coined or scored regions, or a combination of coined and scored regions.

6. A closure as claimed in claim 5, wherein the one or more coined and/or scored region(s) extend to a depth of no more than 60% of the thickness of the sealing panel and have a radial width of no more than 20% of the radial width of the sealing panel.

7. A closure as claimed in claim 6, wherein the depth of the coined and/or scored region(s) extends between 40 to 50% of the thickness of the sealing panel and the radial width of the coined and/or scored region(s) is between 5% to 20% of the radial width of the sealing panel.

8. A closure as claimed in claim 1, wherein the sealing panel of the annular component is formed of material with a thickness of less than or equal to 0.15 mm.

9. A closure as claimed in claim 1, wherein the annular component is integral to a container body.

10. A closure for a container comprising:

a metal annular component having:

an inner peripheral curl that defines an access opening for the container, the access opening defining a plane; and a sealing panel disposed radially outward from the inner peripheral curl, the sealing panel configured to bond with a peelable lidding material, the sealing panel having a radial width and defining a radially inner portion that extends from proximate the inner peripheral curl for one quarter of the radial width of the sealing panel, the radially inner portion comprising a circumferential hinge defined by one or more annular bands, the one or more annular bands being thinned relative to surrounding material of the sealing panel, wherein the sealing panel is tiltable about the hinge relative to the plane.

11. A closure as claimed in claim 10, wherein:

i. in the case of a single annular band, the single band is discontinuous; or ii. in the case of two or more annular bands, at least one of the bands is discontinuous.

12. A closure as claimed in claim 10, wherein the sealing panel is provided with only a single annular band, the single band provided on an upper surface of the radial inner portion.

13. A closure as claimed in claim 10, wherein the one or more annular band(s) are disposed on an upper surface of the radial inner portion of the sealing panel, with the lid bonded to the sealing panel so that the lid covers and the annular bond region and extends either side of the band(s).

14. A closure as claimed in claim 1, wherein the one or more annular band(s) is provided by one or more annular coined or scored regions, or a combination of coined and scored regions.

15. A closure as claimed in claim 14, wherein the one or more coined and/or scored region(s) extend to a depth of no more than 60% of the thickness of the sealing panel and have a radial width of no more than 20% of the radial width of the sealing panel.

16. A closure as claimed in claim 15, wherein the depth of the coined and/or scored region(s) extends between 40 to 50% of the thickness of the sealing panel and the radial width of the coined and/or scored region(s) is between 5% to 20% of the radial width of the sealing panel.

17. A closure as claimed in claim 10, wherein the sealing panel of the annular component is formed of material with a thickness of less than or equal to 0.15 mm.

18. A closure as claimed in claim 10, wherein the annular component is integral to a container body.

19. A closure as claimed in claim 1, wherein the sealing panel is disposed radially outward of the circumferential hinge.

20. A closure as claimed in claim 10, wherein the sealing panel is disposed radially outward of the circumferential hinge.

21. A closure as claimed in claim 1, wherein the radial outer portion tilts relative to the inner peripheral curl about the circumferential hinge.

22. A closure as claimed in claim 10, wherein at least a portion of the sealing panel tilts relative to the inner peripheral curl about the circumferential hinge.

* * * * *